United States Patent [19]

Cappotto

[11] 3,976,182

[45] Aug. 24, 1976

[54] AUTOMATIC FUNCTION MECHANISM FOR TYPEWRITERS

[75] Inventor: Samuel D. Cappotto, Syracuse, N.Y.

[73] Assignee: SCM Corporation, New York, N.Y.

[22] Filed: June 23, 1975

[21] Appl. No.: 589,728

[52] U.S. Cl. ..... 197/91; 197/151; 197/181

[51] Int. Cl.[2] ..... B41J 19/62; B41J 33/02

[58] Field of Search ..... 197/82, 83, 91, 151, 197/168, 169, 181, 107, 6.7; 242/55, 57

[56] References Cited

UNITED STATES PATENTS

| | | | |
|---|---|---|---|
| 1,475,619 | 11/1923 | Barney | 197/51 |
| 1,608,279 | 11/1926 | Handley | 197/51 |
| 3,194,379 | 7/1965 | Szeluga | 197/151 |
| 3,204,746 | 9/1965 | Wolowitz | 197/181 X |
| 3,346,090 | 10/1967 | Goff et al. | 197/158 |
| 3,632,052 | 1/1972 | Read | 197/160 X |
| 3,637,060 | 1/1972 | McMahon | 197/6.7 |
| 3,643,778 | 2/1972 | Anderson | 197/151 |
| 3,729,081 | 4/1973 | Ozimek et al. | 197/181 X |
| 3,804,227 | 4/1974 | Cappotto et al. | 197/151 |
| 3,882,990 | 5/1975 | Genesio | 197/181 |
| 3,927,746 | 12/1975 | Wolowitz | 197/151 |
| 3,927,747 | 12/1975 | Wolowitz | 197/151 |
| 3,927,748 | 12/1975 | Wolowitz | 197/181 |
| 3,927,749 | 12/1975 | Wolowitz | 197/181 |

*Primary Examiner*—Edgar S. Burr
*Assistant Examiner*—Paul T. Sewell
*Attorney, Agent, or Firm*—Stanley J. Klem; Milton M. Wolson

[57] ABSTRACT

A method and mechanism for automatically performing typewriter functions such as backspacing a carriage. The backspace mechanism is actuated by the insertion and removal of a ribbon cartridge that is placed on and guided by a ribbon cartridge platform and is especially suited for use in conjunction with the correction of erroneously typed characters.

The ribbon cartridge carries a pair of cam surfaces that engage a pair of typewriter backspace coupled cam surfaces to actuate a backspace function upon insertion and again upon removal of the ribbon cartridge. Therefore, automatic multiple backspacing of the typewriter carriage occurs when performing an error correcting operation simply by inserting and removing a correction ribbon cartridge.

Although a backspace function has been selected for purposes of demonstration, the hereafter disclosed embodiment may be utilized to actuate other typewriter functions upon the insertion and removal of the ribbon cartridge.

28 Claims, 6 Drawing Figures

AUTOMATIC FUNCTION MECHANISM FOR TYPEWRITERS

BACKGROUND OF THE INVENTION

The present invention relates to mechanisms for typewriters that utilize printing ribbon cartridges in general and include those of the type disclosed in U.S. Pat. No. 3,643,777 entitled TYPEWRITER RIBBON CARTRIDGE granted Feb. 22, 1972 and U.S. Pat. application Ser. No. 150,946 filed June 9, 1971 with Carl Anderson et al as inventors and entitled TYPEWRITER RIBBON CARTRIDGE, both of which are assigned to the assignee of the instant application.

The present application also represents an improvement over a simultaneously filed application entitled AUTOMATIC FUNCTION MECHANISM FOR TYPEWRITERS with Edwin Hurley as inventor in that the present application teaches the actuation of a backspace function upon insertion and removal of a cartridge and does not require the disabling of the escapement.

The term "cartridge" as used hereinafter is defined to include any form of ribbon holder or container irrespective of configuration and the manner of insertion into the typewriter.

One particularly useful typewriter function that may be accomplished by the actuating mechanism of this invention is to provide an automatic backspace operation upon insertion of a cartridge and another automatic backspace operation upon removal of the cartridge. A typical backspace operation that may be automated by the actuating mechanism of this invention is fully disclosed in U.S. Pat. No. 3,482,671 entitled BACKSPACE MECHANISM FOR TYPEWRITERS granted on Dec. 9, 1969 with Richard Shattuck as inventor and assigned to the same assignee as the instant application. When cooperating with a modified cartridge housing an error correction tape therein, manual backspacing steps necessary for error correction are directly eliminated.

The term "typewriter function" is defined to include any typewriter operation which provides for the alignment of a selected platen impact point relative to the typewriter print point.

Error correction devices for typewriters as disclosed in the prior art, have required a series of sequential manual operations of the typewriter. For example, when an operator typed an erroneous character, it was first necessary to depress the backspace key to actuate the backspace mechanism thereby repositioning the typewriter carriage to the proper printing station for making the correction. The typist would then manually position a section of correction tape over the printing station and overstrike the erroneously typed character to cover the error with correction material. Another backspace operation would then be necessary to again reposition the typewriter carriage to the proper printing station so that the correct letter may be typed over the correction material. Therefore, a series of manipulative operations by the operator are necessary to correct each erroneously typed character. The end result of the foregoing is that the typing speed is significantly reduced relative to the amount of erroneous characters typed, thereby significantly increasing the time and the cost required for the preparation of typed material.

Furthermore, the operator would inherently waste substantial amounts of correction ribbon. It is necessary to hold the correction ribbon or strip with the fingers to properly position and continuously hold the correction ribbon at the printing station until the erroneously typed character is re-struck and correction material deposited to the writing paper. The remaining portion of the correction ribbon could be unsuitable for further use, due to the correction material being rubbed from the surface of the ribbon by contact with the fingers. Consequently, a greater segment of correction ribbon might be required to correct one erroneously typed character.

The present invention overcomes the foregoing disadvantages while conserving correction material and providing an automatic spacing operation upon insertion and removal of a ribbon cartridge. With the wide distribution and use of photo copying machines, it has been customary to make only a ribbon copy and thereafter reproduce additional copies. Thus, there is no necessity to correct any multiple carbon copies.

Other advantages of the present invention will become more fully apparent from the following description.

SUMMARY OF THE INVENTION

The inventive concept disclosed contemplates the method and means for automatically actuating a selected typewriter function a first time upon cartridge insertion and a second time upon cartridge removal.

An application of this concept is an automatic backspacing mechanism which is illustrated in cooperation with a typewriter ribbon cartridge containing an error correction ribbon. The ribbon cartridge includes an abutment, the bottom edge of which defines two cam surfaces. The abutment is positioned on and projects from the rear wall of the ribbon cartridge where it engages the automatic backspacing mechanism upon insertion and again upon removal of the ribbon cartridge from the typewriter. A ribbon cartridge platform is fixed within the typewriter to provide a support for the ribbon cartridge. An upstanding wall of the ribbon cartridge support carries a pivotal actuating lever that is coupled to a typewriter backspace mechanism. The top of the actuating lever defines two cam surfaces that are in the path of the correction ribbon cartridge abutment cam surfaces when the correction ribbon cartridge is inserted into the typewriter.

When an erroneous character is printed, the printing ribbon cartridge containing an inked ribbon is removed. The error correction ribbon cartridge is then inserted into the typewriter. As the correction ribbon cartridge is being inserted, a first cam surface on the wall of the correction ribbon cartridge progressively engages a first cam surface on the actuating lever. The actuating lever is urged to pivot down and, through linkage, actuates the backspace mechanism to reposition the typewriter carriage to the proper printing station for correction of the erroneously typed character. The erroneously typed character is then re-struck through the correction ribbon to cover the previously struck character with correction material. The correction ribbon cartridge is then removed from the typewriter. As the correction ribbon cartridge is being removed from the typewriter, a second cam surface on the correction ribbon cartridge wall progressively engages a second cam surface on the actuating lever. The actuating lever is again urged to pivot down and, through linkage, actuates the backspace mechanism a second time to reposition the typewriter carriage to the proper printing station for retyping of the correct character. The printing ribbon cartridge is then reinserted and the correct character is typed over the correction material.

Accordingly, it is an object of the present invention to provide a method and means for automatically actuating a selected typewriter function upon both insertion and removal of a cartridge therefrom.

A further object of the present invention is to provide a simple, inexpensive, and reliable mechanism that automates the backspacing operation of a typewriter.

A further object of the present invention is to provide a typewriter structure which will automatically and precisely reposition the carriage of a typwriter for typing and correcting over a previously typed character without manual manipulation when a cartridge is inserted and removed from the typewriter.

Other objects, features, and advantages of the invention will become more apparent from the following description, including appended claims, and accompanying drawing.

DESCRIPTION OF THE PREFERRED EMBODIMENT

Although the inventive concept may be illustrated in conjunction with a variety of typewriter functions, the following embodiment has, for the purpose of clarity and ease of description, been confined to a common and readily employed function, namely, back-spacing and error correction. The principle of this invention can be readily applied to other typewriter functions utilizing the embodiments described herein as examples.

Figure 1:
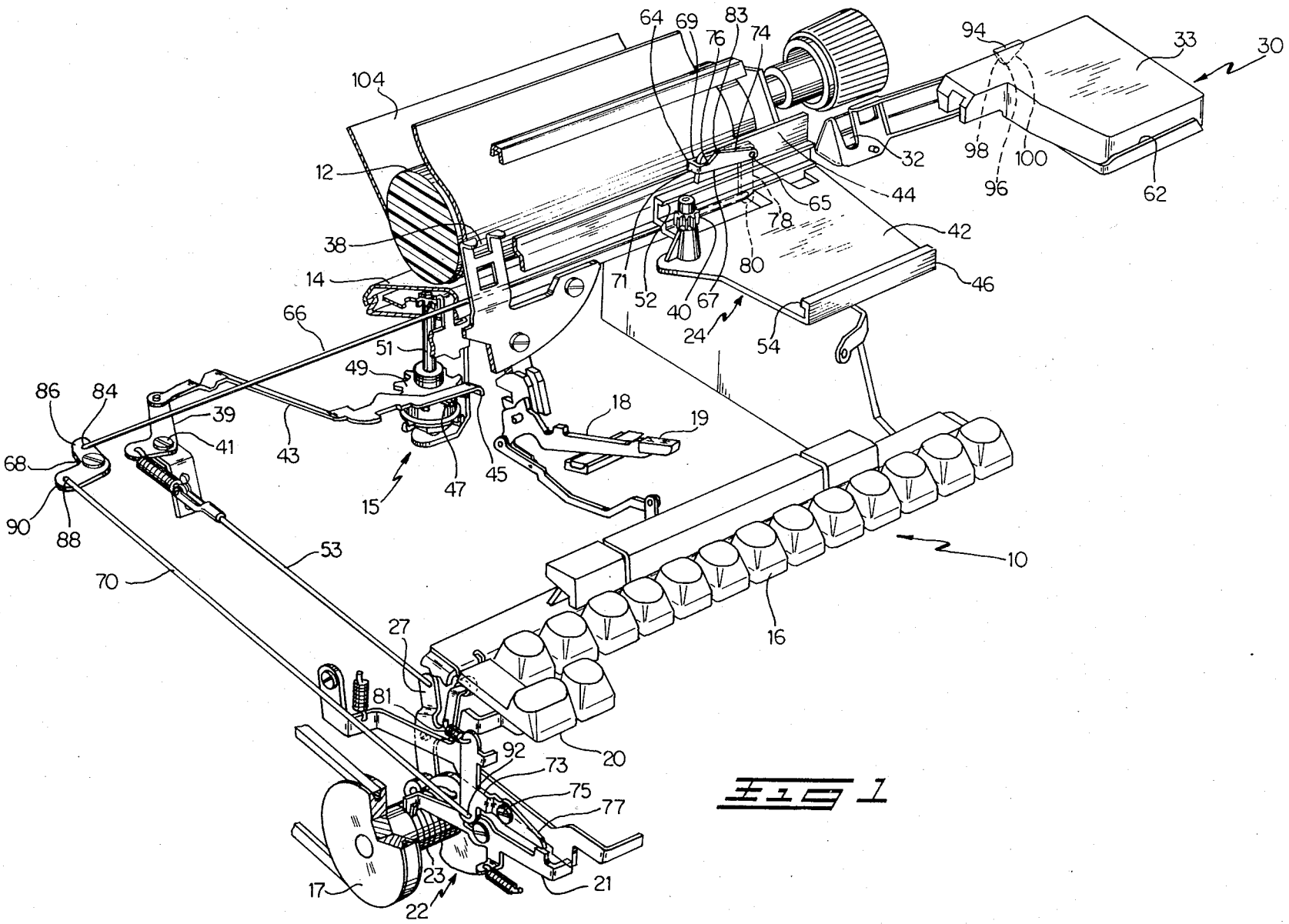
FIG. 1 is a perspective view of portions of a typewriter incorporating the invention.

The illustrated embodiment of FIG. 1 shows a typewriter 10 that includes a traversable printing platen 12 that is supported on an incrementally movable carriage 14, the movement of which is controlled by an escapement mechanism 15, such as the type that is fully disclosed in U.S. Pat. No. 2,649,179 entitled CARRIAGE FEEDING ESCAPEMENT MECHANISM and having the same assignee as the instant application. The typewriter also includes a plurality of character keys 16 for actuating a plurality of typebars 18, only one of which is shown, and function keys 20 for actuating other typewriter instrumentalities, namely, a backspace mechanism 22.

Figure 2:
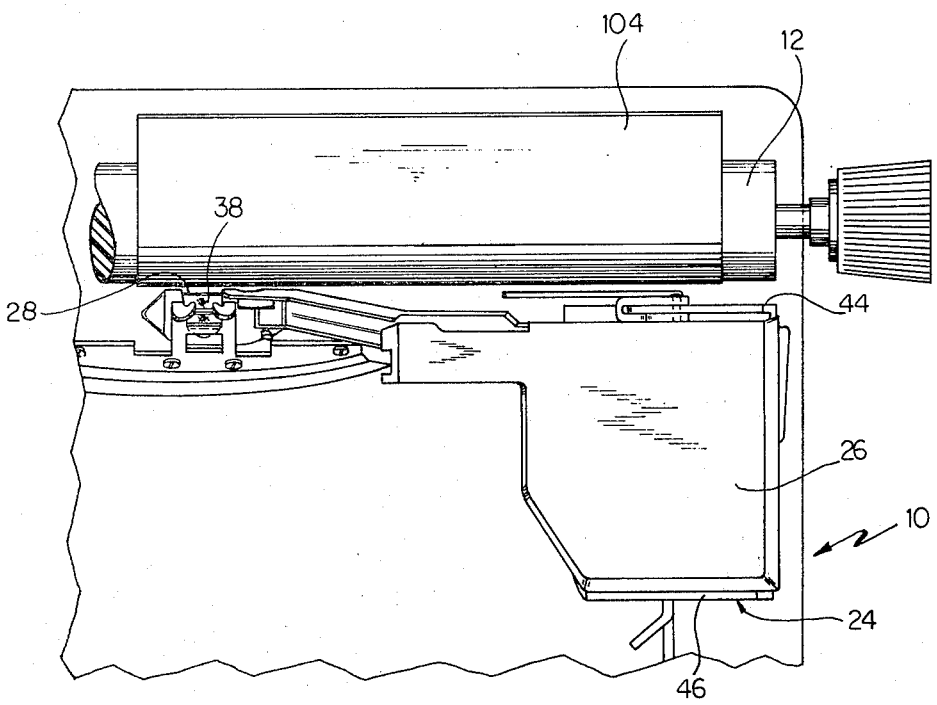
FIG. 2 is a top view of a portion of the typewriter of FIG. 1 with a printing ribbon cartridge installed therein.
Figure 3:
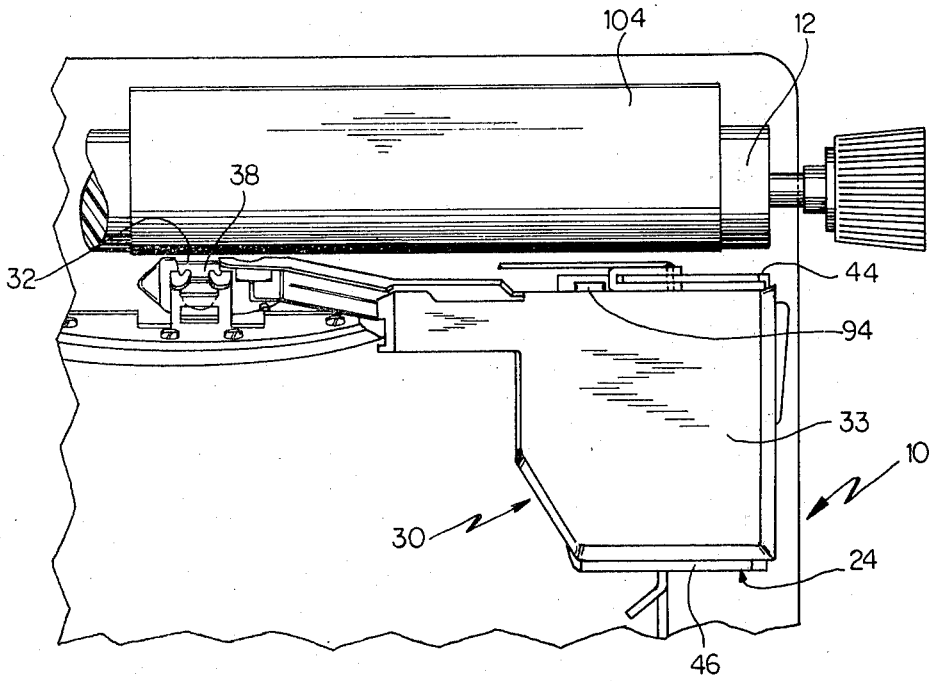
FIG. 3 is a top view of a portion of the typewriter of FIG. 1 with an error correction ribbon cartridge installed therein.

A ribbon cartridge platform 24 is fixed within the confines of typewriter 10, preferably in a horizontal plane. Ribbon cartridge platform 24 provides a support for a ribbon cartridge of the type described in the above referred to patent application assigned to the present assignee or may be readily adapted to accept a variety of structurally different cartridges. Within a cartridge housing there may be disposed a variety of ribbons including a correction ribbon 32. For the sake of clarity, two cartridges are distinguished structurally as shown in FIG. 2 showing a printing ribbon cartridge 26 that contains a typewriter printing ribbon 28 or an error correction ribbon cartridge 30 shown in FIGS. 1, 3, 4, and 5 that contains an error correction ribbon 32. Ribbon cartridge platform 24 is precisely positioned to provide support for ribbon cartridges of the foregoing type so that a printing station of a ribbon cartridge ribbon carrier arm is in alignment with a printing station of the typewriter when ribbon cartridges are inserted into the ribbon cartridge platform 24. Ribbon cartridge platform 24 further includes a feed means 40 that is engageable by a ribbon cartridge to feed ribbon along the arm.

The structure of ribbon cartridge platform 24 includes a flat base 42 having a pair of integral walls 44 and 46 extending upwards therefrom. Wall 44 and 46 are parallel to and spaced from one another to provide precise guiding for the insertion of a ribbon cartridge. Walls 44 and 46 include opposed overhanging retaining shelves 52 and 54. Shelves 52 and 54 overlie cooperating ledges 60 and 62 of the ribbon cartridges to prevent upward movement of the cartridges when they are inserted into ribbon cartridge platform 24.

Figure 4:
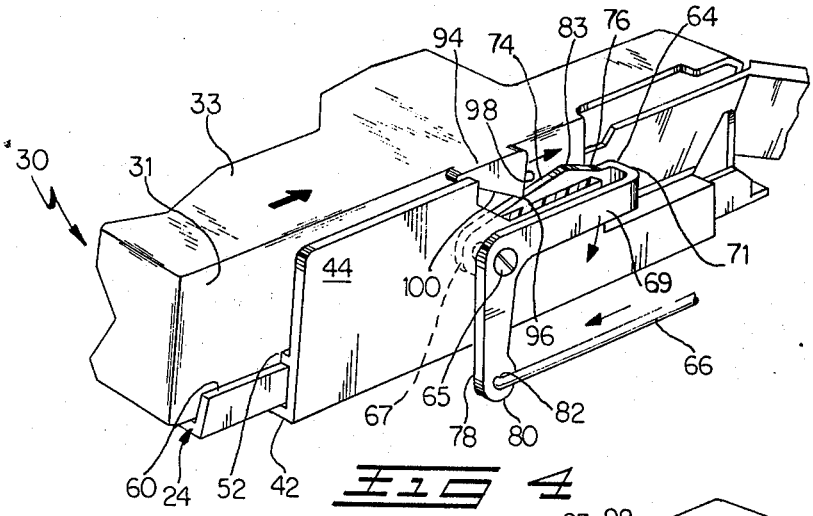
FIG. 4 is an enlarged rear perspective view of a portion of the error correction ribbon cartridge as it is being inserted into the ribbon cartridge support platform.
Figure 5:
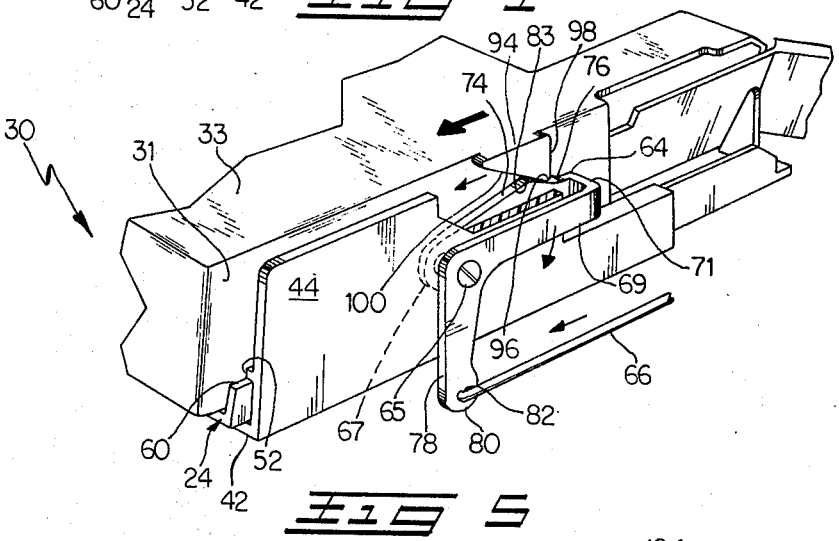
FIG. 5 is a view as shown in FIG. 4 with the error correction ribbon cartridge as it is being removed from the ribbon cartridge support platform.

The automatic backspacing mechanism best shown in FIGS. 1, 4, and 5, includes a cam lever 64 that is connected to backspace mechanism 22 by a link 66, a bellcrank 68, a link 70, and a spring urged backspace trip bellcrank 73.

Cam lever 64 includes a pair of parallel spaced apart arms 67 and 69 joined at one end by a base 71 to form a generally U shaped upper configuration. Arm 69 includes a downwardly transverse extension 78. Cam lever 64 is supported for pivotal movement about stud 65 which passes through the lever 64 proximate the juncture of arm 69 and extension 78 through upstanding wall 44 and terminates in an aligned aperture in arm 67. Wall 44 terminates proximate the base 71 thereby permitting support and pivotal action thereof. Arm 67 which is disposed on the side of wall 44 that receives the ribbon cartridge 30 has its uppermost edge formed with an intermediate apex 83 to define a pair of opposed cam surfaces 74 and 76.

The linkage between cam lever 64 and backspace mechanism 22 includes a pair of link shafts 66 and 70 having an intermediate bellcrank 68 therebetween. A trip bellcrank 73 terminates at link 70. Any other suitable mechanical linkage between the cam lever 64 and the backspace mechanism 22 can be employed.

Link 66 has one end 82 pivotally connected to extension 78 for converting the pivotal movement into a transverse linear movement and other end 84 pivotally connected to an arm 86 of bellcrank 68. Link 70 has one end 88 pivotally connected to a second arm 90 of bellcrank 68 and the other end 92 pivotally connected to trip bellcrank 73. A spring 81 biases bellcrank 73 to its home position.

The error correction cartridge is provided with a camming abutment 94 which is disposed on a rear wall 31 and projects therefrom in the path of cam lever 64 as ribbon cartridge 30 is inserted. Abutment 94 is positioned on rear wall 31 adjacent a top 33 of ribbon cartridge 30 and is of triangular form to define a sloped camming surface 98 and 100 on its lowermost edge. Camming surfaces 98 and 100 are disposed for slideable engagement with camming surfaces 74 and 76 of cam lever 64 when the ribbon cartridge 30 is being inserted and removed from the typewriter. After camming surface 98 trips cam lever 64, spring 81 returns it to its home position so that lever 64 is in position for subsequent activation.

In order to more fully appreciate the significance of the present invention, a typical non-automated error correction operation will hereafter be described as it pertains to ribbon spool typewriters.

Figure 6:
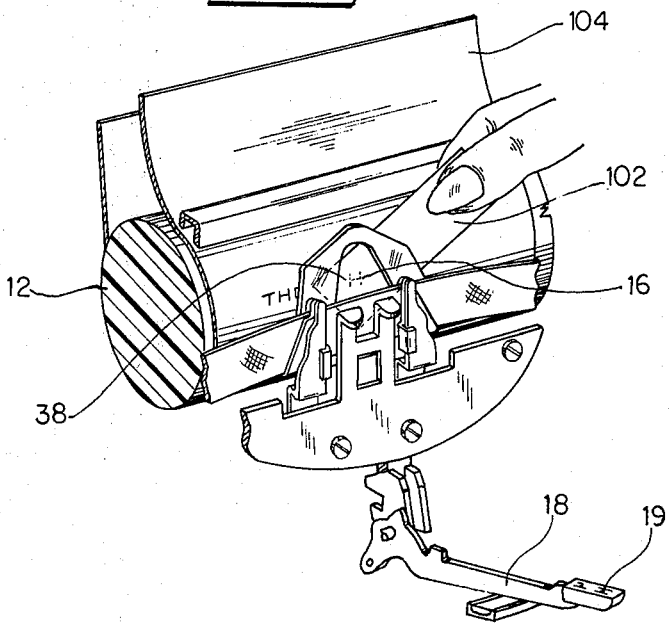
FIG. 6 is a top view of a portion of the typewriter of FIG. 1 showing a section of correction ribbon being held in position in front of the typewriter printing station preparatory to overstriking an error.

During normal practice when an operator types an erroneous character and carriage 14 traverses one letter space, the following sequence of operations must be performed to correct the error. It is necessary that backspace key 20 be depressed to actuate backspace mechanism 22. The backspace mechanism 22 activates a backspace function that repositions typewriter carriage 14 to the proper position for making the correction. A backspace function occurs when backspace key 20 is depressed and an actuator bellcrank 21 is urged to pivot clockwise. A spring clutch 23 is thereby actuated to couple backspace mechanism 22 with a power source 17. A bellcrank 27 pivots clockwise and pulls link 53 frontward, which in turn pivots a bellcrank 39 counterclockwise about a pin 41. Bellcrank 39 drives a backspace link 43 toward the left, which causes a tab 45 to engage a tooth 47 of a starwheel 49. Starwheel 49 rotates clockwise about a shaft 51 thereby backspacing carriage 14 one letter space. The proper position of the carriage is where the erroneously typed character is repositioned in alignment with typewriter printing station 38. The operator would then manually position a section of correction tape 102 adjacent the writing paper 104 over printing station 38 as shown in FIG. 6. The erroneous character key 16 is then depressed whereby typebar 18 carrying the erroneous type 19 would overstrike the erroneous charaacter that was previously typed on writing paper 104 and thereupon carriage 14 traverses one letter space. The striking of correction tape 102 by typebar 18 causes white correction material from correction tape 102 to be deposited on writing paper 104 thereby rendering the eroneous typed characters semi-invisible. It is necessary that backspace key 20 is depressed again to actuate a backspace function so that the correct character may be typed over the correction material previously deposited on writing paper 104. Normal typing can now continue. The procedure of backspacing typewriter carriage 14, manually positioning a section of correction tape 102 over printing station 38, overstriking the erroneously typed character and depositing correction material thereon, backspacing the typewriter carriage 14 a second time, and then typing the correct character is a procedure that must be repeated for each erroneously typed character. Furthermore, the handling of correction tape 102 by the operator results in correction material being rubbed from the surface possibly causing the remaining portion of correction tape 102 to be unsuitable for further corrections resulting in substantial waste of correction tape.

In typewriters adapted for using ribbon cartridges not equipped with the subject invention, the same multiple backspacing operations are required. However, instead of manually handling a section of correction tape, it is only necessary to remove printing ribbon cartridge 26 from the typewriter and install an error correction ribbon. The correction ribbon is self-contained within the error correction cartridge. To accomplish an error correction operation after an erroneous character is typed and carriage 14 traverses one letter space, it is first necessary to remove printing ribbon cartridge 26 and insert the error correction ribbon cartridge. Backspace key 20 is then depressed to activate the backspace function. Carriage 14 is then repositioned to its previous letter space position whereupon the erroneous character key 16 is depressed to actuate typebar 18 that contains the erroneous type 19. Carriage 14 traverses one letter space as type 19 strikes correction ribbon 32 and correction material from correction ribbon 32 is deposited on writing paper 104 to render the erroneous typed character semi-invisible. The error correction ribbon cartridge is then removed from the typewriter and printing ribbon cartridge 26 is inserted for printing. Backspace key 20 is again depressed to activate a single backspace function that repositions carriage 14 to its previous letter space position so that the correct character may be typed over the correction material previously deposited on writing paper 104. Normal typing can now continue. The above procedure of removing printing ribbon cartridge 26, inserting the error correction ribbon cartridge, backspacing carriage 14, overstriking the erroneously typed character and depositing correction material thereon, removing the error correction ribbon cartridge and inserting the printing ribbon cartridge, backspacing carriage 14 a second time, and then typing the correct character is a procedure that must be repeated for each erroneously typed character.

The present invention substantially automates the error correction procedure and overcomes the undesirable procedure of multiple backspace operations that are required to correct an erroneously typed character. During normal practice when an operator types an erroneous character on a typewriter containing the automated backspace mechanism of the present invention, the following sequence of operations are required to correct the error. The operator must first remove printing ribbon cartridge 26 from the typewriter. Then the operator inserts error correction ribbon cartridge 30 into the typewriter. Backspace mechanism 22 is automatically actuated in the following manner. Error correction ribbon cartridge 30 is inserted into the typewriter 10 where it is supported by base 42 of ribbon cartridge platform 24 and precisely guided by platform upstanding walls 44 and 46. As error correction ribbon cartridge 30 is progressively slid along ribbon cartridge platform 24, first cam surface 98 of abutment 94 progressively engages first cam surface 74 of cam lever 64 and urges cam lever 64 to pivot downward about pivot stud 65. As cam lever 64 pivots downward, extension 78 pulls link 66 rightward, and by way of bellcrank 68, overcomes the biasing effect of spring 81, and pulls link 70 rearward. The rearward movement of link 70 urges backspace trip bellcrank 73 to pivot clockwise about its mounting pivot 75. A forward extending arm 77 of backspace trip bellcrank 73 engages and urges bellcrank 21 to pivot clockwise and activate backspace mechanism 22. At this time, abutment edge 96 has passed beyond apex 83 of cam lever 64 and lever 64 is biased to its home position by spring 81. Simultaneously, carriage 14 is repositioned to its previous letter space position for the error correction operation. The erroneous character key 18 is depressed whereby erroneous character 16 is overstruck and white correction material from correction tape 32 is deposited on writing paper 104. Error correction ribbon cartridge 30 is then removed from typewriter 10. As error correction ribbon cartricge 30 is being removed from typewriter 10, by progressively sliding along ribbon cartridge platform 24, second cam surface 100 of abutment 94 progressively engages second cam surface 76 of cam lever 64. Cam lever 64 is urged to pivot downward a second time and actuate the backspace operation a second time to reposition carriage 14 to previous letter space position. Printing ribbon cartridge 26 is then inserted into typewriter 10 and the correct character is typed over the correction material previously deposited on writing paper 104.

It is clear from the above that where a typewriter is adapted with response means for actuating a selected typewriter function, the use thereof requires only the steps of inserting and removing a suitable cartridge. The procedure of removing printing ribbon cartridge 26, installing error correction ribbon cartridge 30, overstriking the erroneously typed character, removing error correction ribbon cartridge 30 and re-inserting printing ribbon cartridge 26 and typing the correct character is greatly simplified and automated compared to typewriters not containing the automated backspacing mechanism.

While the foregoing description has shown and described the fundamental novel features as applied to a preferred embodiment, it will be understood by those skilled in the art that modifications embodied in various forms may be made without departing from the spirit and scope of the invention.

What is claimed is:

1. In a typewriter which includes operational means for said typewriter to perform at least one typewriter function for causing the alignment of a selected platen impact point relative to the typewriter print point and having means for receiving a cartridge, that improvement which comprises;

means disposed in the typewriter and engageable by the cartridge for actuating said operational means upon insertion and removal of the cartridge into the typewriter to thereby perform at least a selected one of said functions.

2. In a typewriter as defined in claim 1 wherein said receiving means includes a platform fixed in the typewriter for supporting and guiding the cartridge in the typewriter.

3. In a typewriter as defined in claim 1 wherein said actuating means includes means responsive to contact with said cartridge for actuating the function when the cartridge is being inserted into the typewriter and for actuating the function a second time when the cartridge is being removed from the typewriter.

4. In a typewriter as defined in claim 3 wherein said responsive means includes a lever pivotally carried by the typewriter in the path of travel of the cartridge when the cartridge is inserted into and removed from the typewriter.

5. In a typewriter as defined in claim 2 wherein said typewriter further includes a function mechanism and said actuating means includes on said receiving platform responsive to said cartridge for actuating the function mechanism when the cartridge is being inserted into the typewriter and actuating the function a second time when the cartridge is being removed from the typewriter.

6. In a typewriter as defined in claim 5 wherein said responsive means includes a lever pivotally disposed on a wall of the cartridge platform and in the path of travel of the cartridge for engaging the cartridge upon insertion into the typewriter and for engaging the cartridge upon removal from the typewriter.

7. In a typewriter as defined in claim 6 wherein said responsive means further includes linkage means operatively connected to the function mechanism for transmitting motion from said lever to the function mechanism.

8. In a typewriter as defined in claim 1 wherein said actuating means further includes means on said receiving platform responsive to contact with another surface for actuating a function mechanism upon the insertion and removal of a cartridge which cartridge is provided with a surface that will contact said further means.

9. The typewriter according to claim 8 wherein said means on said platform is an abutment carried thereby.

10. In a typewriter having operational means to perform a carriage backspacing function and means for receiving a ribbon cartridge, comprising:

means disposed in the typewriter and engageable by the ribbon cartridge for actuating said operational means upon insertion of the ribbon cartridge into the typewriter; and means disposed in the typewriter and engageable by the ribbon cartridge for actuating said operational means to thereby perform the backspace function upon removal of the ribbon cartridge from the typewriter.

11. In a typewriter as defined in claim 10 wherein said receiving means includes a platform fixed in the typewriter for supporting and guiding the ribbon cartridge in the typewriter.

12. In a typewriter as defined in claim 10 wherein a portion of said actuating means is carried by said cartridge and includes an abutment disposed on a wall of the ribbon cartridge and further includes means on said receiving platform responsive to said abutment for actuating said operational means when the ribbon cartridge is being inserted into the typewriter and for actuating said operational means a second time when the ribbon cartridge is being removed.

13. In a typewriter as defined in claim 12 wherein said responsive means includes a lever pivotally disposed on a wall of the ribbon cartridge platform and in the path of travel of the ribbon cartridge for engaging said abutment when the ribbon cartridge is being inserted into the typewriter and for engaging said abutment a second time when the ribbon cartridge is being removed.

14. In a typewriter as defined in claim 13 wherein said responsive means further includes linkage means operatively connected to said operational means for transmitting motion from said lever to said operational means.

15. In a typewriter of the type which includes receiving means for an insertable and removable ribbon cartridge and is provided with an improved backspacing mechanism, the improvement comprising in combination:

means carried by the typewriter for operationally activating the backspace mechanism; and co-acting means carried by the ribbon cartridge for actuating said activating means of the typewriter to initiate the backspace mechanism upon insertion and removal of the ribbon cartridge.

16. In a typewriter as defined in claim 15 wherein said activating means includes a cam lever pivotally disposed in the path of travel of the ribbon cartridge and said co-acting means includes a camming abutment disposed on the ribbon cartridge for engaging said cam lever when the ribbon cartridge is inserted into and removed from the typewriter.

17. In a typewriter as defined in claim 15 wherein said receiving means includes a platform fixed in the typewriter for supporting and guiding the ribbon cartridge.

18. In a typewriter as defined in claim 16 wherein said camming abutment includes a cam surface on its lowermost edge and said cam lever includes a cam surface on its uppermost edge for engaging said camming abutment when the ribbon cartridge is guided on the ribbon cartridge platform.

19. In a typewriter as defined in claim 15 wherein said activating means further includes linkage means operatively connected to the backspace mechanism for transmitting motion from said lever to the backspace mechanism.

20. An automatic backspace actuating mechanism for a typewriter having a backspace mechanism responsive to the depressing of a backspace key, a ribbon cartridge platform fixed in the typewriter, the automatic backspace actuating mechanism comprising:

means insertable into and removable from the typewriter for actuating the backspace mechanism; and means on the ribbon cartridge platform responsive to said insertable and removable means for actuating the backspace mechanism independent of the backspace key.

21. An automatic backspace actuating mechanism as defined in claim 20 wherein said insertable means is an abutment and said responsive means includes a lever that is pivotally supported on a wall of the ribbon cartridge platform and engageable by said abutment for pivotal movement relative to said platform wall.

22. An automatic backspace actuating mechanism as defined in claim 21 wherein said abutment includes a first cam surface on its lowermost edge and said lever includes a first cam surface on its uppermost edge for engaging said abutment first cam surface when the ribbon cartridge is inserted into the typewriter, said abutment further includes a second cam sufrace on its lowermost edge and said lever further includes a second cam surface on its uppermost edge for engaging said abutment second cam surface when the ribbon cartridge is removed from the typewriter.

23. An automatic backspace actuating mechanism as defined in claim 21 wherein said responsive means further includes linkage means operatively connected to the backspace mechanism for transmitting motion from said lever to the backspace mechanism.

24. An automatic backspacing mechanism for typewriters that utilize ribbon cartridges, the typewriter having an incrementally traversable printing platen for supporting a printing medium, a plurality of typebars for impacting on the printing medium during traversing, a plurality of corresponding keys for actuating the typebars and other typewriter instrumentalities, a backspace mechanism responsive to another key for incrementally reversing the forward traverse of the printing platen, a ribbon cartridge platform fixed in the typewriter for supporting and guiding the ribbon cartridge into the typewriter to position a ribbon at a printing station in front of the printing medium whereby the key actuated typebars impact thereon to transfer character images through the ribbon of the ribbon cartridge to the printing medium, wherein the improvement comprises:

means on the ribbon cartridge for actuating the backspacing mechanism; and means on the ribbon cartridge platform responsive to the ribbon cartridge actuating means for actuating the backspace mechanism when the ribbon cartridge is inserted into the typewriter and for actuating the backspace mechanism when the ribbon cartridge is removed.

25. An automatic backspacing mechanism as defined in claim 24 wherein said actuating means includes an abutment on a wall of the ribbon cartridge and said responsive means includes a lever that is pivotally supported on a wall of the ribbon cartridge platform and engageable by said abutment for pivotal movement relative to said platform wall.

26. A method for twice actuating a functional operation for causing the alignment of a selected platen impact point relative to the typewriter print point of a typewriter mechanism independent of a function key, which comprises:

inserting a ribbon cartridge into the typewriter for actuating the functional operation; and removing a ribbon cartridge from the typewriter for actuating the functional operation.

27. A method for controlling the operation of a typewriter mechanism, which comprises:

moving a surface of a typewriter ribbon cartridge in one direction against a structure in the typewriter for effecting a function for causing the alignment of a selected platen impact point relative to the typewriter print point of the typewriter independent of a function key; and moving a surface on the typewriter ribbon cartridge in a direction opposite said one direction against a mechanism in the typewriter for effecting a function for causing the alignment of a selected platen impact point relative to the typewriter print point of the typewriter independent of a function key.

28. A method for automatically actuating the backspace operation of a typewriter mechanism, which comprises:

inserting a ribbon cartridge into a typewriter; and thereby actuating the backspace mechanism upon insertion of said ribbon cartridge; and removing the ribbon cartridge from the typewriter and thereby actuating the backspace mechanism a second time.

* * * * *